US009446592B2

(12) United States Patent
Seki et al.

(10) Patent No.: US 9,446,592 B2
(45) Date of Patent: Sep. 20, 2016

(54) LIQUID EJECTION CARTRIDGE AND LIQUID EJECTION APPARATUS

(71) Applicant: CANON KABUSHIKI KAISHA, Tokyo (JP)

(72) Inventors: Sayaka Seki, Tokyo (JP); Kiyomitsu Kudo, Machida (JP); Yuichiro Akama, Tokyo (JP); Satoshi Kimura, Kawasaki (JP); Tomotsugu Kuroda, Yokohama (JP); Kyosuke Toda, Kawasaki (JP); Naoko Tsujiuchi, Kawasaki (JP); Yosuke Takagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,609

(22) Filed: May 22, 2015

(65) Prior Publication Data

US 2015/0343770 A1 Dec. 3, 2015

(30) Foreign Application Priority Data

May 30, 2014 (JP) ..... 2014-112193
Mar. 23, 2015 (JP) ..... 2015-059403

(51) Int. Cl.
*B41J 2/175* (2006.01)
*B41J 23/00* (2006.01)
*B41J 2/14* (2006.01)

(52) U.S. Cl.
CPC ..... *B41J 2/1433* (2013.01); *B41J 2/1752* (2013.01); *B41J 2/17553* (2013.01); *B41J 2002/14491* (2013.01)

(58) Field of Classification Search
CPC B41J 2/17513; B41J 2/17503; B41J 2/1752; B41J 2/17553; B41J 2/17526; B41J 2/17523; B41J 2/17546; B41J 2/17559; B41J 25/304
USPC ..... 347/37, 84–86, 50
See application file for complete search history.

(56) References Cited

U.S. PATENT DOCUMENTS 6,113,224 A 9/2000 Sugama et al.
6,378,992 B2 4/2002 Kudo et al.
6,435,669 B1 8/2002 Nakata et al.
6,447,103 B1 9/2002 Sugama et al.
(Continued)

FOREIGN PATENT DOCUMENTS

WO 2012/054050 A1 4/2012

OTHER PUBLICATIONS

Copending unpublished U.S. Appl. No. 14/719,614 to Yuichiro Akama, filed May 22, 2015.
(Continued)

*Primary Examiner* — An Do
(74) *Attorney, Agent, or Firm* — Fitzpatrick, Cella, Harper & Scinto

(57) ABSTRACT

A liquid ejection head includes a liquid ejection section including an element substrate having ejection ports for ejecting liquid and an electrical wiring substrate connected to a contact of the liquid ejection apparatus to transmit signals to the element substrate, a liquid tank loading section including a containing space for containing a liquid tank storing liquid to be supplied to the element substrate and a lock member having an engaging part for engaging with a holding part of the liquid tank and a fixation means for rigidly securing the liquid election section and the liquid tank loading section in position.

15 Claims, 4 Drawing Sheets

(56) References Cited

U.S. PATENT DOCUMENTS

| | | | | |
|---|---|---|---|---|
| 6,491,380 | B2 | 12/2002 | Taneya et al. | |
| 6,502,917 | B1 * | 1/2003 | Shinada | D06M 13/44 347/19 |
| 6,582,065 | B1 | 6/2003 | Okazaki et al. | |
| 6,595,626 | B2 | 7/2003 | Kudo et al. | |
| 6,652,076 | B2 | 11/2003 | Nakata et al. | |
| 7,740,333 | B2 | 6/2010 | Takei et al. | |
| 8,240,814 | B2 | 8/2012 | Saikawa et al. | |
| 8,246,146 | B2 | 8/2012 | Toda et al. | |
| 8,998,375 | B2 | 4/2015 | Amma et al. | |
| 2010/0165025 | A1 | 7/2010 | Takei et al. | |
| 2014/0307027 | A1 | 10/2014 | Toda et al. | |

OTHER PUBLICATIONS

Copending unpublished U.S. Appl. No. 14/719,625 to Tomotsugu Kuroda, filed May 22, 2015.

* cited by examiner

LIQUID EJECTION CARTRIDGE AND LIQUID EJECTION APPARATUS

BACKGROUND OF THE INVENTION

1. Field of the Invention

The present invention relates to a liquid ejection head to be mounted on a liquid ejection apparatus.

2. Description of the Related Art

In some liquid ejection apparatus, which may typically be inkjet type recording apparatus, one or more liquid tanks storing liquid such as ink are mounted on the liquid ejection head of the apparatus. Since liquid is directly supplied from the liquid tank or tanks to the liquid ejection head of the liquid ejection apparatus of this type, the apparatus does not require any tube for connecting the liquid tank or tanks, whichever appropriate, and the liquid ejection head and other related parts. Therefore, liquid ejection apparatus of this type can be made highly compact and supplied at low cost.

International Publication No. WO2012/054050 discloses a liquid ejection head of this types. The liquid tank containing space of the liquid ejection head is defined by a peripheral wall surrounding the liquid tank contained in the space on all sides and a side wall located at a forward position as viewed in the direction in which the liquid tank is inserted. The side wall is provided with a liquid feed pipe for connecting the liquid tank to the ejection ports of the apparatus. As the liquid tank is loaded in the liquid tank containing space, the liquid feed pipe is forced to run through the liquid supply port of the liquid tank and liquid is supplied from the liquid tank to the ejection ports. The peripheral, wall and the side wall are integrally formed.

In some instances, the liquid tank to be loaded in a liquid ejection apparatus is required to have a large capacity depending on the application of the liquid ejection apparatus. For example, a liquid ejection apparatus may be required to be loaded with a liquid tank having an increased capacity without modifying the remaining features of the apparatus. In some instances, an increasing capacity of only specified kinds of liquid tanks of a liquid ejection apparatus using plural kinds of liquids may be required. For the liquid ejection head described in the International Publication No WO2012/054050 to deal with such a request, the overall configuration of the liquid ejection head needs to modified. However, modifying an entire liquid ejection head including the parts thereof that are not related to the capacity of liquid tank such as the liquid feed pipe is disadvantageous from the viewpoint of economy.

SUMMARY OF THE INVENTION

The present invention provides a liquid ejection head including: a liquid ejection section including an element substrate having ejection ports for ejecting liquid and an electrical wiring substrate connected to a contact of the liquid ejection apparatus to transmit signals to the element substrate; a liquid tank loading section including a containing space for containing a liquid tank storing liquid to be supplied to the element substrate and a lock member having an engaging part for engaging with a holding part of the liquid tank; and a fixation means for rigidly securing the liquid ejection section and the liquid tank loading section in position.

Further features of the present invention will become apparent from the following description of exemplary embodiments with reference to the attached drawings.

DESCRIPTION OF THE EMBODIMENTS

Now, embodiments of the present invention will be described below by referring to the accompanying drawings. Note that, in the following description, terms including "top plate", "bottom plate", "side plate", "upper part", "upward", "lower part", "downward", "height", "vertical direction" and so on are defined in a state where a liquid ejection head is in operation and hence a liquid ejection head is mounted on a liquid election apparatus or in a state were a liquid tank is loaded in the liquid election head that mounted a liquid ejection apparatus. "Inserting direction Y1" refers to the direction in which a liquid tank is inserted into a liquid ejection head and "extracting direction (releasing direction) Y2" refers to the direction in which a liquid tank is drawn out from a liquid ejection head, while "inserting/extracting directions Y" include both the inserting direction Y1 and the extracting direction Y2.

Figure 1:
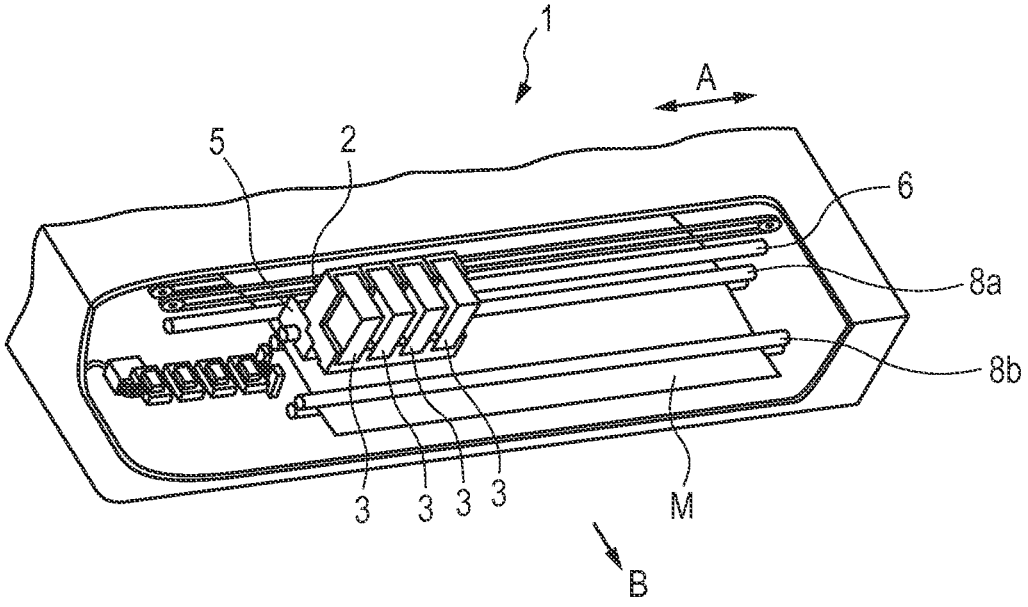
FIG. 1 is a schematic perspective view of a liquid ejection apparatus to which a liquid ejection head according to the present invention is applicable, illustrating the entire liquid ejection apparatus.

FIG. 1 is a schematic perspective view a liquid ejection apparatus, schematically illustrating the configuration thereof. The liquid ejection apparatus 1 has a liquid election head 2. The liquid ejection head 2 ejects the liquid supplied from a liquid tank 3 through a large number of ejection ports according to the recording information applied to it. The liquid tank 3 is removably loaded in the liquid ejection head 2. The liquid ejection apparatus 1 of this embodiment employs liquids of four different types (colors) of black, cyan, magenta and yellow. Thus, four liquid tanks 3 respectively storing black, cyan, magenta and yellow liquids are loaded in the liquid ejection head 2. Each of the liquid tanks 3 may be provided with an atmospheric air passage (not illustrated) for allowing the inside of the liquid tank 3 to communicate with the atmosphere. In the following description, expressions such as the first liquid, the second liquid and so on may sometimes be used in order to discriminate liquids of the different colors. Similarly, "ejection port", "liquid tank", "liquid feed pipe", "electrical connector member", "positioning pin", "liquid supply port", "electrical substrate" and "positioning hole" may sometimes be preceded by a term such as "the first", "the second" or the like for the purpose of discriminating the liquid tanks and the components related to them.

The liquid ejection head 2 is removably mounted on a carriage 5. The carriage 5 is slidably supported by a guide rail 6 and adapted to be driven by a drive section (not illustrated), which may typically be a motor, to move back and forth along the guide rail 6. As a result, the liquid ejection head 2 can reciprocate in the directions A (main scanning directions). A recording member M is conveyed in the direction B (sub scanning direction), which is orthogonal to the reciprocating directions of the carriage 5, by a conveyance roller pair 8*a*, 8*b* while the recording member M is held vis-á-vis the ejection port surface of the liquid ejection head 2 where the ejection ports open and the distance between the recording member M and the ejection port surface is held constant and invariable. Liquid droplets of different colors are selectively ejected from the ejection ports of the liquid ejection head 2 as the liquid ejection head 2 is driven to reciprocate in the directions A for a main scanning operation and also to move in the direction B for a sub scanning operation at a predetermined pitch. Then, as a result, the ejected liquid droplets adhere to the recording member M to form character(s), symbol(s) and/or image(s) on the recording member M. The materials that can be used for the recording member M non-limitatively include ordinary paper, special paper and transparency OHP film.

Figure 2A:
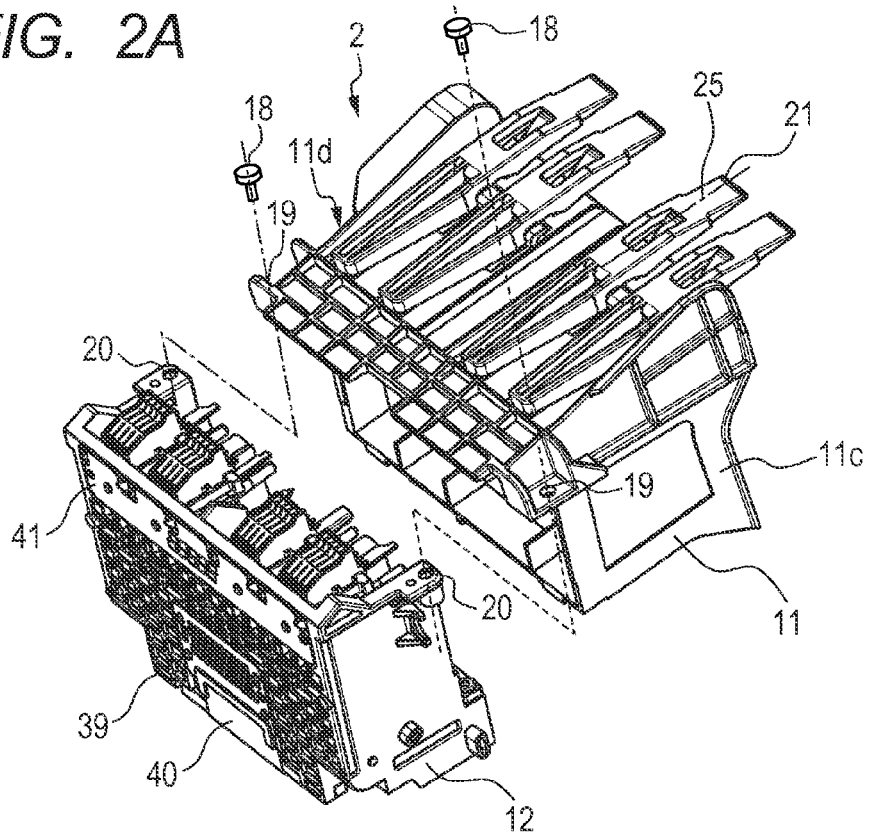
FIGS. 2A and 2B are schematic perspective views of a liquid ejection head according to the present invention, illustrating the entire liquid ejection head.
Figure 2B:
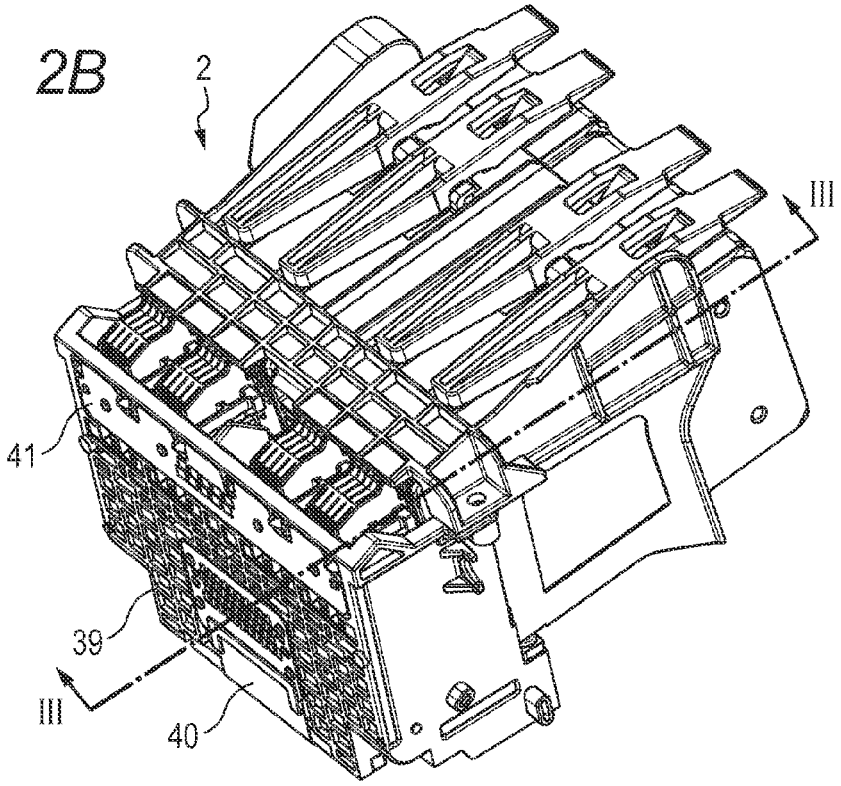
Figure 3:
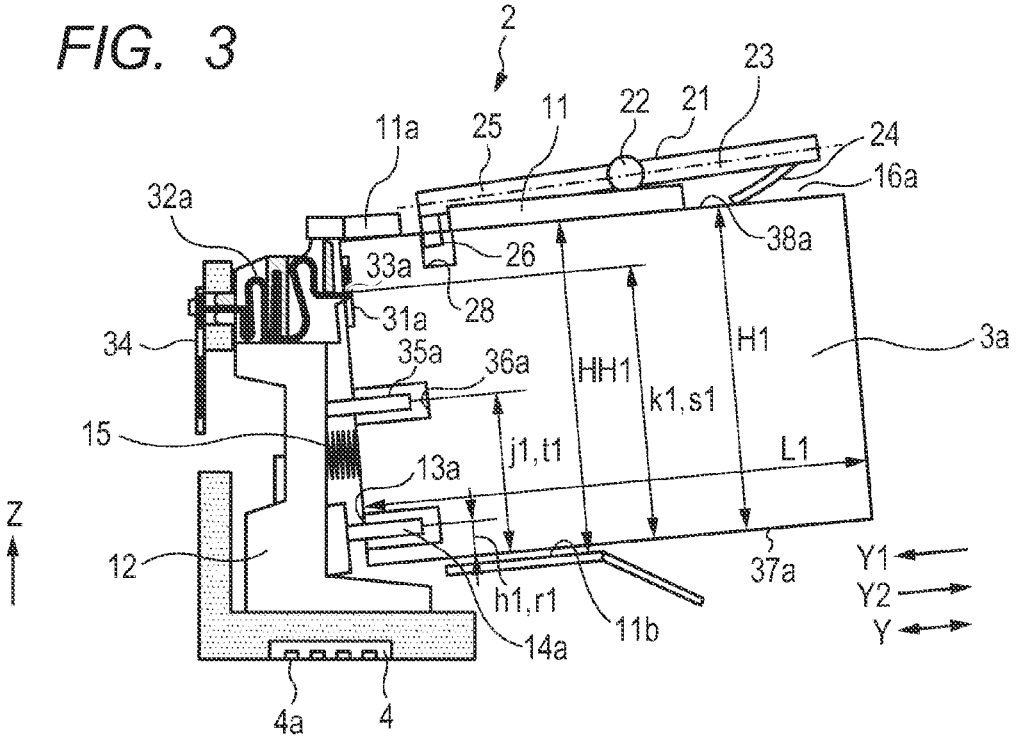
FIG. 3 is a schematic cross-sectional view of the liquid ejection head of FIGS. 2A and 2B taken along line III-III in FIG. 2B.

Now, the configuration, of the liquid ejection head 2 will be described below by referring to FIGS. 2A, 2B and 3. FIG. 2A is an exploded schematic perspective view of the liquid election head and FIG. 2B is a schematic perspective view of the liquid ejection head that has already been assembled. FIG. 3 is a schematic cross-sectional view of the liquid ejection head taken along line III-III in FIG. 25. The liquid ejection head 2 roughly includes a liquid tank loading section 11 and a liquid ejection section 12.

The liquid ejection section 12 by turn includes an element substrate 4 that is provided with first ejection ports 4*a* for ejecting the first liquid and a first liquid feed pipe 14*a* that runs through the first liquid supply port 13*a* of the first liquid tank 3*a* to supply the first liquid of the first liquid tank 3*a* to the first ejection port 4*a*. The first liquid feed pipe 14*a* extends substantially straight in the extracting direction Y2 of the first liquid tank 3*a* and is designed to be forced to run through the first liquid supply port 13*a* located at a lower part of the first liquid tank 3*a* when the first liquid tank 3*a* is loaded in position. The liquid ejection section 12 has an energy generating element (not illustrated) for applying energy necessary for ejecting the first liquid and the first liquid that is heated by the energy generating element is ejected from the first ejection ports 4*a*. The liquid ejection section 12 additionally has a resilient member 15 for urging the loaded first liquid tank 3*a* in the extracting direction Y2. In this embodiment, the resilient member 15 is a coil spring that can expand and contract in the inserting/extracting directions Y of the first liquid tank 3*a*. The liquid ejection section 12 is provided with a first electrical wiring substrate 39, which is a printed substrate having a plurality of terminals for transmitting signals and electric power from the liquid ejection apparatus 1 to the element substrate 4 and a flexible wiring substrate 40 for electrically connecting the element substrate 4 and the first electrical wiring substrate. The liquid ejection section 12 is additionally provided with a second electrical wiring substrate 41 that is a printed substrate having a plurality of terminals for electrical transmissions between the first liquid tank 3*a* and the liquid ejection apparatus 1. As will be described in greater detail hereinafter, the electrical substrate 31*a* of the first liquid tank 3*a* electrically communicates with the main body of the liquid ejection apparatus 1 by way of the electrical connector section 32*a* and the second electrical wiring substrate 41 arranged in the liquid ejection section 12. As the first electrical wiring substrate 39 and the second electrical wiring substrate 41 are arranged on a same surface or the liquid ejection section 12, each of the electrical wiring substrates can be made to have an appropriate size and also can be down-sized if compared with an instance where a single electrical wiring substrate is employed in place of the first electrical wiring substrate 39 and the second electrical wiring substrate 41. Additionally, the strength of the surface of the liquid election section 12 for receiving the electrical wiring substrates is improved when the second electrical wiring substrate 41 is arranged across the entire width of the surface for receiving the electrical wiring substrates.

The liquid tank loading section 11 has a containing space for containing the first liquid tank 3*a* storing the first liquid. The liquid tank loading section 11 has a box-shaped frame structure that includes a top plate 11*a*, a bottom plate 11*b* and two side plates 11*c* and 11*d* that link the top plate 11*a* and the bottom plate 11*b*. The top plate 11*a*, the bottom plate 11*b* and the side plates 11*c* and 11*d* form the containing space 16*a* for containing the first liquid tank 3*a* along with the liquid ejection section 12 located in front of the first liquid tank 3*a* as viewed in the inserting direction Y1 of the first liquid tank 3*a*. The liquid tank loading section 11 is rigidly secured to the liquid ejection section 12 by a fixation means 18. The fixation means 18 of this embodiment is a pair of screws. The screws 18 are driven to run through the respective holes 19 formed in the liquid tank loading section 11 and engaged with the respective screw holes 20 formed in the liquid ejection section 12 to rigidly secure the liquid tank loading section 11 to the liquid election section 12. Thus, when manufacturing the liquid ejection head 2, the liquid tank loading section 11 and the liquid ejection section 12 are prepared as separate members and then they are put together and rigidly secured to each other by the fixation means 18. However, the fixation means 18 is not limited to a pair of screws and any other securing method such as welding, the use of an adhesive or interlocking (engagement) may alternatively be used.

The liquid tank loading section 11 has a lock member 21 for rigidly holding the first liquid tank 3*a* that is loaded in the liquid tank loading section 11. The lock member 21 is located on the upper surface of the to plate 11*a* of the liquid tank loading section 11. The lock member includes an oblong lever 23 that extends in the inserting direction Y1 and is rotatable around a fulcrum of rotation 22 and a leaf spring 24 that is located at a rear part of the first liquid tank 3*a* as viewed in the inserting direction Y1 and extends obliquely downwardly. A claw section 26 that extends downwardly and substantially orthogonally relative to the longitudinal axial line 25 of the lever 23 is formed at a front end of the first liquid tank 3*a* as viewed in the inserting direction Y1, that is, at the end of the lever 23 that is opposite to the end of the lever 23 were the leaf spring 24 is formed with the fulcrum of rotation 22 of the lever 23 interposed between the lead spring 24 and the claw section 26. The first liquid tank 3*a* is provided on the top surface 38*a* thereof with a recess 28 that is a holding part and can be engaged with the claw section (engaging part) 26 of the lever 23.

At the time of loading the first liquid tank 3*a*, the first liquid tank 3*a* is inserted into the inside of the containing space 16*a* while the first liquid tank 3*a* is being driven to slide along the bottom plate 11*b* of the liquid loading section 11. As the first liquid tank 3*a* is inserted, the leaf spring 24 is compressed between the lever 23 and the first liquid tank 3*a* and the front end of the leaf spring 24 is forced to slide on the top surface 38*a* of the liquid tank 3*a*. The lever 23 is subjected to a counterclockwise moment around the fulcrum of rotation 22 as illustrated in FIG. 3 due to the resilient restoring force of the leaf spring 24 so that the claw section 26 of the lever 26 is forced to slide on the top surface 38*a* of the first liquid tank 3*a*. The first liquid tank 3*a* contacts the resilient member 15 and is urged in the extracting direction Y2 by the resilient member 15. As the first liquid tank 3*a* is inserted further, resisting the urging force of the resilient member 15, until the first liquid tank 3*a* gets to the predetermined loading position, the claw section. 26 of the lever 23 becomes engaged with the recess 28 due to the resilient restoring force of the leaf spring 24 so that the first liquid tank 3*a* is locked at the loading position so as to be rigidly secured there. When the first liquid tank 3*a* is to be unloaded, the rear end of the lever 23 as viewed in the inserting direction Y1 is pressed downward to release the claw section 26 of the lever 23 from the engagement thereof with the recess 28. Then, the first liquid tank 3*a* is pushed out in the extracting direction Y2 by the urging force of the resilient member 15 so that the first liquid tank 3*a* can be taken out from the liquid tank loading section 11 with ease.

The liquid ejection section 12 additionally has an electrical connector member 32*a* for establishing electrical connection between the liquid ejection section and the electrical substrate 31*a* of the first liquid tank 3*a* when the first liquid tank 3*a* is loaded in the liquid tank loading section 11. The electrical connector member 32*a* is located between the claw section 26 and the resilient member 15 as viewed in the vertical direction Z. The end part 33*a* of the electrical connector member 32*s* that is electrically connected to the electrical substrate 31*a* projects in the extracting direction Y2 and the other end part of the electrical connector member 32*a* is connected to the electrical wiring substrate 34. The electrical wiring substrate 34 is connected to the control section (not illustrated) of the liquid ejection apparatus main body. Signals representing the information on the quantity of liquid remaining in the first liquid tank 3*a* and so on are transmitted to the control section of the liquid ejection apparatus main body by way of the electrical substrate 31*a*, the electrical connector member 32*a* and the electrical wiring substrate 34.

The liquid ejection section 12 has a first positioning pin 35*a* for highly precisely positioning the first liquid tank 3*a* when the first liquid tank 3*a* is loaded in the liquid tank loading section 11. The first positioning pin 35*a* is arranged between the electrical connector member 32*a* and the first liquid feed pipe 14*a* and engaged with the first positioning hole 36*a* that extends in the extracting direction Y2 from the front surface of the first liquid tank 3*a* as viewed in the inserting direction Y1 thereof. While both the first positioning pin 35*a* and the first positioning hole 36*a* of this embodiment have a cylindrical profile, they may have any other profile so long as the first positioning pin 35*a* can snugly be engaged with the first positioning hole 36*a*. Then, as a result, the first liquid tank 3*a* is restricted against any move to improve the reliability of the electrical connection between the electrical, connector member 32*a* and the electrical substrate 31*a*. While the single first liquid tank 3*a* is to be loaded in the liquid tank loading section 11 in the above description, a plurality of liquid tanks can be loaded in the liquid tank loading section 11 of this embodiment. As illustrated in FIGS. 2A, 25 and 3, a total of four liquid tanks substantially the same in height can be loaded in the liquid tank loading section 11. Because the liquid tank loading section 11 has a box-shaped frame structure and lock members 21 are arranged on the upper surface thereof, a plurality of liquid tanks can removably be loaded in the liquid tank loading section 11 with the same degree of easiness for loading and unloading with regard to all the liquid tanks. While the liquid tanks to be loaded in the liquid loading section 11 preferably have substantially the same height, the liquid tanks may have different widths depending on the requirements of the specifications that the respective liquid tanks need to meet. For example, the tank for black ink may be made to have a width that is greater than the width of the tanks for other color inks. The resilient, members 15 and the liquid feed pipes 14*a* are arranged in the frame structure.

In certain instances, liquid tanks having different capacities can be loaded on a same liquid ejection apparatus depending on the specification and the application of the apparatus. For example, the volume of printed matters to be printed by a liquid ejection apparatus may remarkably vary between when the apparatus is operated for home use and when the apparatus is operated for business use and, if the liquid ejection section 12 of the liquid ejection apparatus is designed so as to be applicable to both home use and business use, large ink tanks having a large capacity may have to be loaded on the apparatus. Different liquid ejection apparatus may normally have to be used when liquid tanks having different capacities need to be used. However, the present invention allows a same liquid ejection apparatus to use liquid tanks having different capacities. For example, a liquid ejection apparatus may be provided with two liquid ejection heads 2 and one of the liquid ejection heads 2 may be loaded with liquid tanks having a relatively small capacity, while the other liquid ejection head 2 may be loaded with liquid tanks having a relatively large capacity. Furthermore, a same liquid ejection head may be loaded with a plurality of liquid tanks having different respective capacities. Thus, for example, a single liquid ejection head may be designed such that the liquid election head can be loaded with liquid tanks for color inks and a liquid tank for black ink having a height greater than the height of the liquid tanks for color inks.

Figure 4:
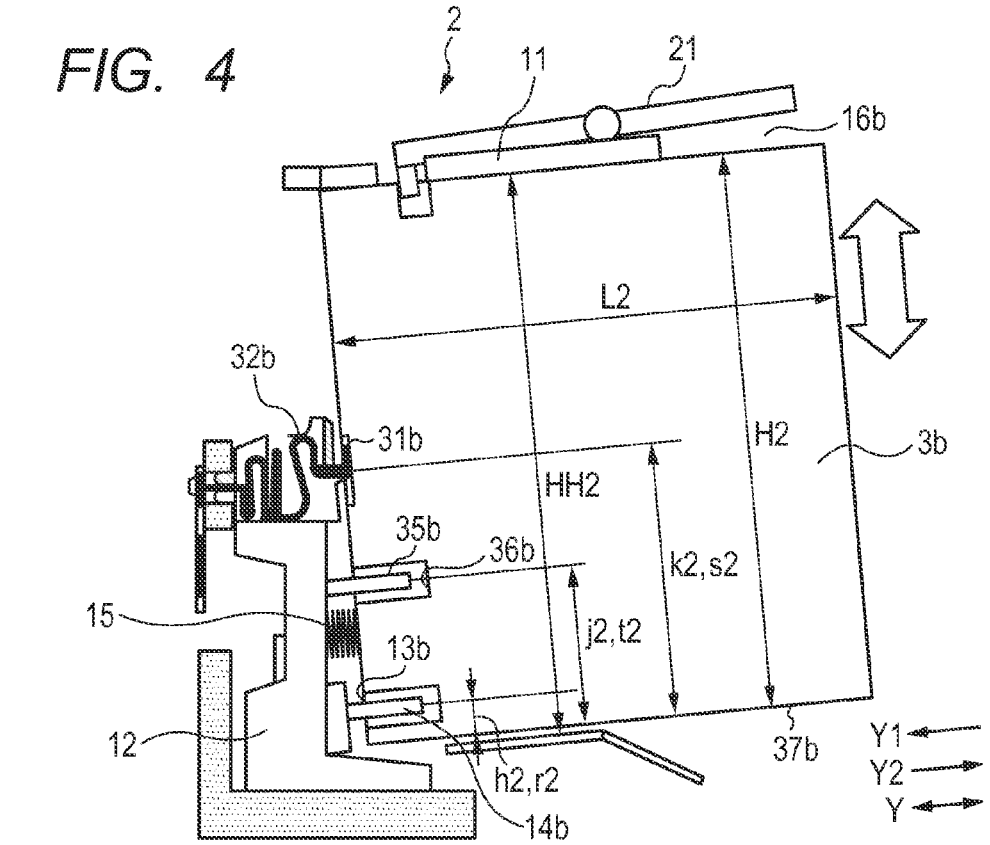
FIG. 4 is a schematic cross-sectional view of a liquid ejection head similar to FIG. 3 that is loaded with a large capacity liquid tank.

FIG. 4 illustrates the configuration of a liquid ejection head 2 to be mounted on a liquid ejection apparatus (e.g., for business use) that is different from the liquid ejection apparatus described above by referring to FIGS. 1 and 3. FIG. 4 is a schematic cross-sectional view similar to FIG. 3 but the second liquid tank 3*b* illustrated there has a capacity greater than the first liquid tank 3*a*. In this embodiment, the second liquid tank 3*b* has a height H2 greater than the height H1 of the first liquid tank 3*a* and the length L2 of the second liquid tank 3*b* as viewed in the inserting/extracting directions Y may well be greater than the length L1 of the first liquid tank 3*a* as viewed in the inserting/extracting directions Y. In other words, both the height and the length of the second liquid tank 3*b* may differ from the height and the length of the first liquid tank 3*a*. In short, at least either the height or the length of the second liquid tank 3*b* differs from the height or the length, whichever appropriate, of the first liquid tank 3*a*. By using a set of liquid tanks including above-described ones, for example, liquid that is used highly frequently (such as black ink) can be supplied from the second liquid tank and other liquids (color inks of cyan, magenta and yellow) can be supplied respectively from the first, third and fourth liquid tanks. Furthermore, when the capacity of a liquid tank is required to be increased or decreased according to the type and the specification of the liquid ejection apparatus to be used with the liquid tank, the first liquid tank 3*a* and the second liquid tank 3*b* may selectively be used for liquid of the same type so as to consequently meet the requirement. However, note that, as pointed out earlier, the present invention is by no means limited to an arrangement for a single apparatus main body to be loaded with a liquid tank having a relatively large capacity and a liquid tank having a relatively small capacity as in the case of this embodiment. For example, a liquid ejection section 12 may be made to be commonly applicable to both a relatively small type apparatus to be loaded with one or more liquid tanks having a relatively small capacity and a relatively large type apparatus to be loaded with one or more liquid tanks having a relatively large capacity, which may typically be for business use. Thus, a single liquid ejection section 12 may commonly be used for two apparatus main bodies while using separate liquid tank loading sections 11 that are adapted respectively to large capacity liquid tanks and to small capacity liquid tanks.

In this embodiment, the height HH2 of the containing space 16*b* for a second liquid tank 3*b* as illustrated in FIG. 4 is made greater than the height HH1 of the containing space 16*a* for a first liquid tank 3*a* as illustrated in FIG. 3 in order to accommodate the difference of height between the first liquid tank 3*a* and the second liquid tank 3*b*. On the other hand, the second liquid feed pipe 14*b* and the first liquid feed pipe 14*a* are arranged at the same level. In other words, the distance h2 in the height direction between the bottom surface 37*b* of the second liquid tank 3*b* and (the center axis of) the second liquid feed pipe 14*b* is equal to the distance h1 in the height direction between the bottom surface 37*a* of the first liquid tank 3*a* and (the center axis of) the first liquid feed pipe 14*a*. Similarly, the second electrical connector member 32*b* and the first electrical connector member 32*a* are arranged at the same level. In other words, the distance k2 in the height direction between the bottom surface 37*b* of the second liquid tank 3*b* and (the center position of the contacting end part of) the second electrical, connector member 32*b* is equal to the distance k1 in the height direction between the bottom surface 37*a* of the first liquid tank 3*a* and (the center position of the contacting end part of) the first electrical connector member 32*a*. Furthermore, the second positioning pin 35*b* and the first positioning pin 35*a* are arranged at the same level. In other words, the distance j2 in the height direction between the bottom surface 37*b* of the second liquid tank 3*b* and (the center axis of) the second positioning pin 35*b* is equal to the distance j1 in the height direction between the bottom surface 37*a* of the first liquid tank 3*a* and (the center axis of) the first positioning pin 35*b*.

Correspondingly, the distance r2 in the height direction between the bottom surface 37*b* of the second liquid tank 3*b* and (the center axis of the second liquid supply port 13*b* is equal to the distance r1 in the height direction between the bottom surface 37*a* of the first liquid tank 3*a* and (the center axis of) the first liquid supply port 13*a*. Likewise, the distance s2 in the height direction between the bottom surface 37*b* of the second liquid tank 3*b* and the second electrical substrate 31*b* (at the center of contact with the electrical connector member) is equal to the distance s1 in the height direction between the bottom surface 37*a* of the first liquid tank. 3*a* and the first electrical substrate 31*a* (at the center of contact with the electrical connector member). Furthermore, the distance t2 in the height direction between the bottom surface 37*b* of the second liquid tank 3*b* and (the center axis of) the second positioning hole 36*b* is equal to the distance t1 in the height direction between the bottom surface 37*a* of the first liquid tank 3*a* and (the center axis of) the first positioning hole 36*a*. In a state where a relatively large capacity liquid tank is loaded as illustrated in FIG. 4, the gap between the electrical connector section 32 and the claw section 26 is greater than the gap between the resilient member 15 and the electrical connector section 32 as viewed in the vertical direction. With the above-described arrangement, a relatively large capacity liquid tank 3*b* is made applicable to the embodiment, while securing the electrical reliability of the embodiment. When a relatively small capacity liquid tank and a relatively large capacity tank are applied to the embodiment at the same time, a same liquid ejection section 12 can commonly be used without damaging the electrical reliability and the loading/unloading reliability of the embodiment.

As described above, the liquid supply port 13*a* that is to be connected with the liquid ejection section 12, the electrical substrate 31*a* and the positioning hole 36*a* of the first liquid tank 3*a* and the liquid supply port 13*b* that is to be connected with the liquid ejection section 12, the electrical substrate 31*b* and the positioning hole 36*b* of the second liquid tank 3*b* are located respectively at the same and identical positions regardless of the difference between the first liquid tank 3*a* and the second liquid tank 3*b* in terms of capacity and dimensions. Additionally, the liquid tank loading section 11, which needs to be replaced by another liquid tank loading section 11 when liquid tanks having a different capacity are to be used, and the liquid ejection section 12 are prepared as separate members and rigidly secured to each other by a fixation means 18. With the above-described measures, when two or more liquid tanks with different capacities are employed, the same liquid ejection section 12 can be used without changing the configuration thereof. As the configuration of the liquid ejection section is not required to be changed as a function of the capacity of the liquid tank that is to be put to use the carriage 5 of a given size can be used constantly. As the liquid ejection section 12, which is provided with the liquid feed pipe 14*a*, and the liquid tank loading section 11 are prepared separately in this way, different liquid ejection heads do not need to be provided to accommodate liquid tanks having different capacities and different, dimensions. In other words, liquid tanks having different capacities and different dimensions can be accommodated by a same liquid ejection head and only different liquid, tank loading sections that are made to match the respective liquid tanks have to be used.

Figure 5A:
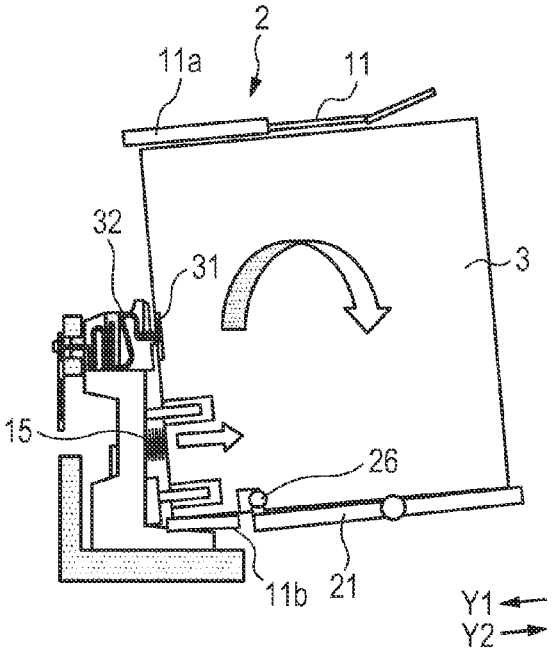
FIGS. 5A and 5B are schematic conceptual illustrations of how the load of a liquid tank is applied to the electrical connector section of a liquid ejection head.
Figure 5B:
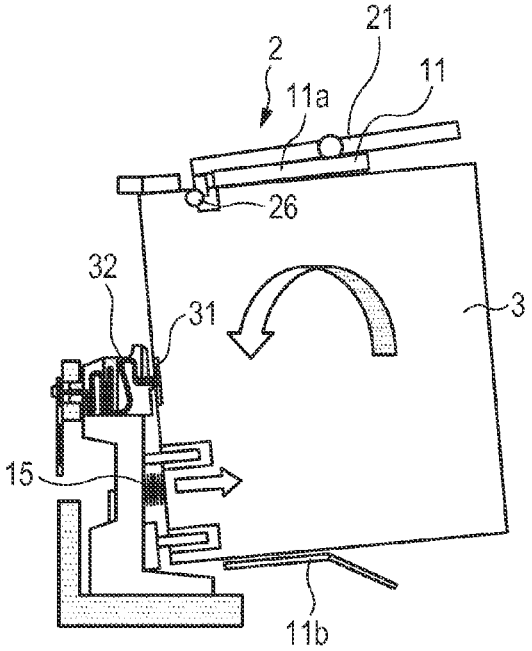

When the liquid ejection head of this embodiment is in operation, the resilient member 15, the electrical connector member 32 and the claw section 26 are arranged in the above-mentioned order from below as viewed in the direction of gravity. Now, the reason why the electrical connector member 32 is arranged between the claw section 26 and the resilient member 15 and the lock member 21 is arranged on the top plate 11 of the liquid tank loading section 11 will be described below by referring to FIGS. 5A and 5B. FIG. 5A illustrates the configuration of a comparative example. More specifically, FIG. 5A illustrates a liquid ejection head in which the lock member 21 of the liquid tank 3 is located on the bottom plate 11*b* of the liquid tank loading section 11 as a comparative example. On the other hand, FIG. 5B illustrates a liquid ejection head similar to that of the above-described embodiments in which the lock member 21 of the liquid tank 3 is located on the top plate 11*a* of the liquid tank loading section 11. The electrical connector member 32 provides a contact point necessary for transmitting information on the quantity of the liquid remaining in the liquid tank 3 and so on to the control section of the liquid ejection apparatus 1. When the electrical contact between the electrical connector member 32 and the electrical substrate 31 of the liquid tank 3 is cut off, the control section of the liquid ejection apparatus 1 can no longer recognize if the liquid tank 3 is loaded in the liquid ejection head 2 or not to consequently adversely affect the control of the liquid ejection apparatus 1. For this reason, the reliability of the contact point between the electrical connector member 32 and the electrical substrate 31 is very important.

Both of the liquid ejection heads 2 illustrated in FIGS. 5A and 5B are urged in the extracting direction Y2 by the resilient member 15 of the liquid tank 3. The liquid tank 3 is rigidly secured to the liquid tank loading section 11 as the lock member 21 ensures this urging force. More specifically, the lock member 21 locks the loaded liquid tank 3 against the urging force of the resilient member 15 but allows the liquid tank 3 to turn around the claw section 26.

In the liquid ejection head 2 illustrated in FIG. 5A, the liquid tank 3 tends to turn clockwise around the claw section 26, which operates as fulcrum of rotation, so as to move the electrical substrate 31 away from the electrical connector member 32. As a result, the reliability of the electrical contact between the electrical substrate 31 and the electrical, connector member 32 becomes unstable. This is because the resilient member 15 is located between claw section 26 and the electrical connector member 32. Particularly, when a large capacity liquid tank is loaded, the position of the center of gravity becomes to be located at a relatively high position to in turn make the posture of the liquid ejection head itself unstable. Then, for this reason, the electrical contact between the electrical connector member 32 and the electrical substrate 31 becomes further unstable when the liquid election head is being moved in the main scanning directions.

To the contrary, in the liquid ejection head 2 illustrated in FIG. 5B, the liquid tank 3 tends to turn counterclockwise around the claw section 26, which operates as fulcrum of rotation, so as to move the electrical substrate 31 to come closer to the electrical connector member 32. Then, the electrical substrate 31 is pressed strongly against the electrical connector member 32 to consequently maintain the reliability of the electrical contact between electrical substrate 31 and the electrical connector member 32. This is because the electrical connector member 32 is located between the claw section 26 and the resilient member 15. For the above-described reason, the electrical connector member 32 is preferably located between the claw section 26 and the resilient member 15 and, when the electrical connector member 32 is located above the resilient member 15 as in this embodiment, the lock member 21 is preferably arranged on the top plate 11*a* of the liquid tank 3.

The moment around the claw section 26 depends on the distance (arm length) between the claw section 26 and the resilient member 15. Therefore, when a liquid tank having a large capacity is to be loaded, the height (the dimension of the tank in the Z-direction) is preferably made large, although the length (the dimension of the tank in the Y-direction) may be made large as described above. When a liquid tank has a large capacity and a large length (in the Y-direction), a moment trying to turn the electrical substrate 31 so as to move the electrical substrate 31 closer to the electrical connector member 32 is generated so that the reliability of the electrical contact between the electrical substrate 31 and the electrical connector member 32 is maintained.

While the present invention has been described with reference to exemplary embodiments, it is to n understood that the invention is not limited to the disclosed exemplary embodiments. The scope of the following claims is to be accorded the broadest interpretation so as to encompass al such modifications and equivalent structures and functions.

This application claims the benefit of Japanese Patent Application No. 2014-112193, filed May 30, 2014, and Japanese Patent Application No. 2015-059403, filed Mar. 23, 2015, which are hereby incorporated by reference herein in their entirety.

What is claimed is:

1. A liquid ejection head comprising:

a liquid ejection section including an element substrate having ejection ports for ejecting liquid, an electrical wiring substrate connected to a contact of the liquid ejection apparatus to transmit signals to the element substrate, a liquid feed pipe to be connected to a loaded liquid tank to supply liquid from the liquid tank to the ejection ports, and an electrical connector member to be electrically connected to the electrical wiring substrate, the electrical connector member being arranged at the liquid tank when the liquid tank is loaded;

a liquid tank loading section including a containing space for containing the liquid tank storing liquid to be supplied to the element substrate and a lock member having an engaging part for engaging with a holding part of the liquid tank; and fixation means for rigidly securing the liquid ejection section and the liquid tank loading section in position, wherein the liquid ejection section includes a positioning pin to be engaged with a corresponding positioning hole of the liquid tank and the positioning pin is located between the electrical connector member and the liquid feed pipe.

2. The liquid ejection head according to claim 1, wherein the liquid ejection section includes a resilient member for urging the loaded liquid tank in a liquid tank unloading direction.

3. The liquid ejection head according to claim 2, wherein a gap between the electrical connector member and the engaging part is greater than a gap between the resilient member and the electrical connector member as viewed in the vertical direction in a state where the liquid tank is loaded in the loading section.

4. The liquid ejection head according to claim 1, wherein the lock member is located on a top plate of the liquid tank loading section in a state where the liquid ejection head is mounted on the liquid ejection apparatus.

5. The liquid ejection head according to claim 1, wherein the electrical connector member protrudes in an unloading direction of the liquid tank.

6. The liquid ejection head according to claim 1, wherein the fixation means is a screw.

7. The liquid ejection head according to claim 1, wherein the liquid ejection section is electrically connected to the electrical connector member and includes a second electrical wiring substrate to be connected to a corresponding contact of a liquid ejection apparatus.

8. The liquid ejection head according to claim 7, wherein the electrical wiring substrate and the second electrical wiring substrate are arranged on a same surface of the liquid ejection section.

9. The liquid ejection head according to claim 1, wherein the liquid tank loading section is formed as a cabinet having a frame structure.

10. A liquid ejection head comprising:

a liquid ejection section including an element substrate having ejection ports for ejecting liquid, an electrical wiring substrate connected to a contact of the liquid ejection apparatus to transmit signals to the element substrate, a liquid feed pipe to be connected to a loaded liquid tank to supply liquid from the liquid tank to the ejection ports, and an electrical connector member to be electrically connected to the electrical wiring substrate, the electrical wiring substrate being arranged at the liquid tank when the liquid tank is loaded;

a liquid tank loading section including a containing space for containing the liquid tank storing liquid to be supplied to the element substrate and a lock member having an engaging part for engaging with a holding part of the liquid tank; and fixation means for rigidly securing the liquid ejection section and the liquid tank loading section in position, wherein the liquid tank loading section includes a cabinet having a frame structure, the lock member is arranged on the top surface of the frame structure, and the liquid ejection section includes a positioning pin to be engaged with a corresponding positioning hole of the liquid tank and the positioning pin is located between the electrical connector member and the liquid feed pipe.

11. The liquid ejection head according to claim 10, wherein the liquid ejection section includes a resilient member for urging the loaded liquid tank in a liquid tank unloading direction.

12. The liquid ejection head according to claim 11, wherein the resilient member and the liquid feed pipe are arranged in the frame structure.

13. The liquid ejection head according to claim 10, wherein the liquid ejection section is electrically connected to the electrical connector member and includes a second electrical wiring substrate to be connected to a corresponding contact of a liquid ejection apparatus.

14. The liquid ejection head according to claim 13, wherein the electrical wiring substrate and the second electrical wiring substrate are arranged on a same surface of the liquid ejection section.

15. The liquid ejection head according to claim 11, wherein the gap between the electrical connector section and the engaging part is greater than a gap between the resilient member and the electrical connector section as viewed in the vertical direction in a state where the liquid tank is loaded in the loading section.

* * * * *